United States Patent [19]

Basil

[11] Patent Number: 4,516,355

[45] Date of Patent: May 14, 1985

[54] LIFT RAIL WINDOW STRUCTURE

[76] Inventor: Dan Basil, 1428 Park Ave., Merrick, Long Island, N.Y. 11566

[21] Appl. No.: 567,966

[22] Filed: Jan. 4, 1984

[51] Int. Cl.[3] ..... E05B 1/00

[52] U.S. Cl. ..... 49/460; 16/125

[58] Field of Search ..... 49/460; 16/124, 125, 16/110 R

[56] References Cited

U.S. PATENT DOCUMENTS

| | | | |
|---|---|---|---|
| 820,231 | 5/1906 | Merryweather | 16/125 |
| 2,084,776 | 6/1937 | Peremi et al. | 49/460 X |
| 2,992,846 | 7/1961 | Schwanz et al. | 49/460 X |

*Primary Examiner*—Philip C. Kannan

*Attorney, Agent, or Firm*—Mandeville & Schweitzer

[57] ABSTRACT

Disclosed herein is an improved window opening structure for a window assembly having an outer frame defining an inner opening having parallel vertical edge surfaces; at least one window sash having vertical side jamb rails, a top rail extending between said jamb rails and a bottom rail extending between said jamb rails; and sash being mounted in said outer frame for sliding movement between a lower window-closed position and an upper window-opening. The opening structure includes a U-shaped opening means having a pair of lift legs and a central lift rail portion extending therebetween and means fastening inner end portions of said lift legs to each of said jamb rails.

5 Claims, 3 Drawing Figures

24
32
30
33
31
33
33
18

3
28
3
25
32
26
33
24
14
2
27
30
13
31
9
2
35
12
10
11
10
35
12
9
12
11

LIFT RAIL WINDOW STRUCTURE

BACKGROUND AND SUMMARY OF THE INVENTION

The present invention relates to window constructions in general and improvements in the opening mechanisms in particular for double hung aluminum windows and the like.

Such double hung windows are now mass-produced, economically and efficiently by the utilization of standardized, extruded metallic elements, for example aluminum, where weather-resistance, light weight, ease of installation, and durability are desired characteristics. Double hung windows, especially those installed in window openings having an especially wide stool, quite often are very difficult to open and close by elderly, weak, or otherwise infirm persons. The present invention incorporates a new and improved, full sash width lift rail.

The new lift rail is disposed in association with the lower sash of a double hung window in a substantially spaced relation to the bottom rail of the window through perpendicular lift arms projecting outwardly from the vertical jamb rails of the lower sash. The projecting lift arms are secured to the lower sash through special lift guides which are securely fastened to the front face of each of the vertical jamb rails at lower portions thereof. The projecting lift arms are welded or otherwise fastened to legs of the L-shaped lift guides, which project outwardly from the plane of the front face of the lower sash.

In accordance with the present invention, this new and improved lift rail arrangement tends to reinforce the lower sash and does not induce deleterious stresses when window opening forces are applied to the sash through the projecting lift arms. Ideally, the lift arms and the lift rail are fabricated from a single U-shaped metallic element. The lift arms are each welded securely to the L-shaped lift guides. As will be understood, the lift arms are of sufficient length to provide substantial leverage so that an elderly or infirm or otherwise weak person may easily raise the lower sash without undue effort through the extreme mechanical advantage provided by the unique new lift rail arrangement. Moreover, where wide stools are associated with the window assembly, the projected lift rail provides easier access to an otherwise more difficult, if not impossible, to reach, lower sash. Indeed, the lift rail of the present invention has extreme utility in window installations where there is an extraordinarily wide stool, which would otherwise necessitate protracted leaning or bending while simultaneously lifting, to open a conventional window having a standard lift rail. With the apparatus of the present invention, a person, whether or not old or infirm, need not bend and lift, subjecting the spine to undue stress, when attempting to vertically lift or to lower a sash. To the contrary, with the new projecting lift rail arrangement, an upward opening force may be readily applied to the lower sash to raise it without unduly stressing the spine and without unduly providing deleterious bending forces to the window sash structure itself.

For a more complete understanding of the present invention and a better appreciation of its attendant advantages, reference should be made to the accompanying drawings in conjunction with the following detailed specification.

DETAILED DESCRIPTION OF THE INVENTION

Figures 1, 2:
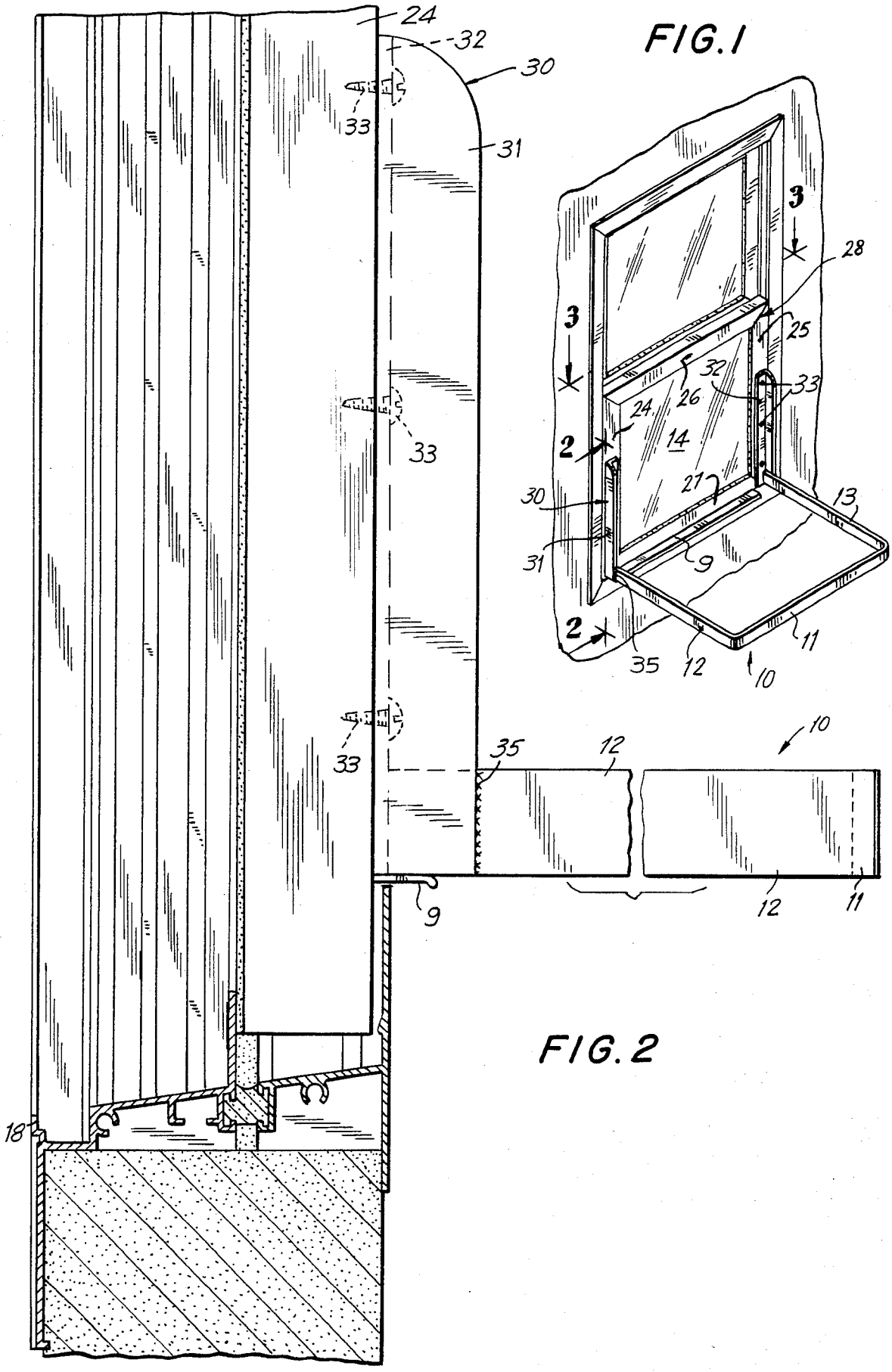
FIG. 1 is a perspective view showing a conventional double hung window, which has been upgraded in accordance with the principles of the details of the present invention, to incorporate the new and improved window lift rail mechanism.
FIG. 2 is an enlarged, fragmentary cross-sectional view showing details of the construction and mounting of the new lift rail assembly taken along 2—2 of FIG. 1.
Figure 3:
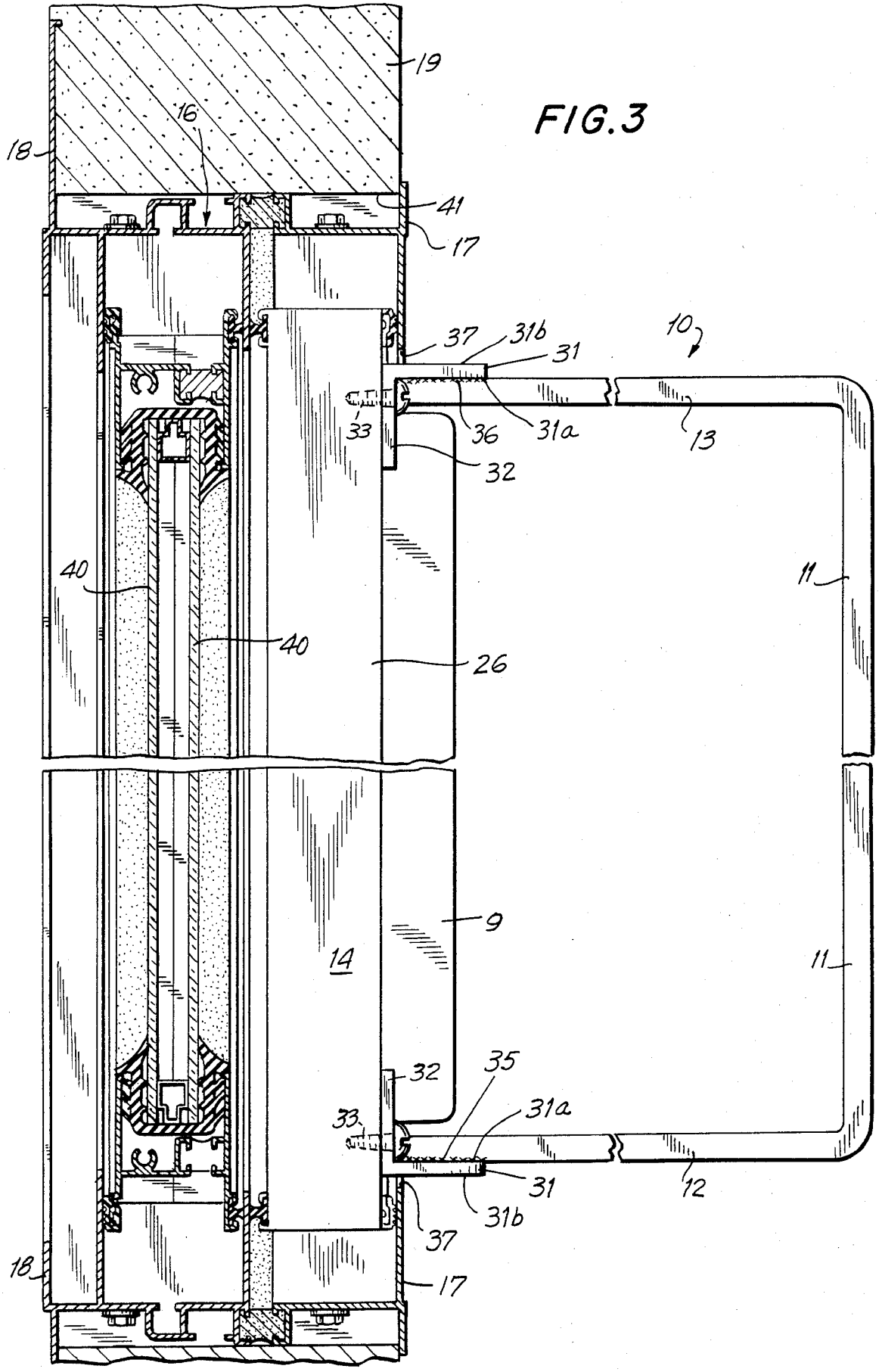
FIG. 3 is an enlarged, fragmentary cross-sectional view of the new lift rail mounted in association with a conventional double hung aluminum window, taken along line 3—3 of FIG. 1.

Referring now to FIGS. 1 through 3, the new and improved window lift rail mechanism of the present invention is generally indicated by reference numeral 10 and includes a horizontal lift rail 11 intergrally supported at its opposite ends by lift arms 12, 13 projecting perpendicularly outwardly from the lower end of the lower sash 14 of a conventional, aluminum double hung window assembly generally indicated at 15. Advantageously the lift rail 11 and lift arms 12, 13, are fabricated from ¼ inch thick by 1 inch wide steel bar stock.

More specifically, the double hung window assembly 15 includes main frame member 16 having an inner molding flange 17 circumscribing the inner rough opening in which the window assembly is mounted within a building structure 19 and an outer molding flange 18, generally circumscribing the outer periphery of the rough window opening 41 in the building construction (FIG. 3).

As is the case with most standard aluminum windows, the outer frame 16 defines channels in which the upper and lower sash members are free to be slidingly moved up and down to open the windows, typically through an integral lift flange 9 or the like. The particular details of the configurations of the sash channels, the means by which the sash are mounted for a movement upwardly and downwardly within the frame 16, and the means for mounting the glazing 40, are not part of the present invention although they are illustrated in the drawings for the sake of completeness of disclosure. It is sufficient for the purposes of practicing and understanding the present invention, that the lower, rectangular sash 14 be comprised of a pair of opposite, parallel vertical jamb rails 24, 25, which are rigidly interconnected by a horizontal upper sash rail 26 and a parallel lower sash rail 27, as indicated in FIG. 1. Completion of the rectangular framing of the sash 14 may be accomplished by mitered or square corner joints 28 or otherwise, in accordance with conventional window making practice.

In accordance with the teachings of the present invention, the new lift rail assembly 10 is secured to the lower sash 14 in the following manner. An L-shaped lift guide 30, fabricated from a length of 1 inch by 1 inch by 1/8 inch thick steel angle or the like, having a vertical guide leg 31 projecting normally from the face of the window and a mounting leg 32 generally disposed in the plane of the window, is fastened to the vertical jamb rails 24, 25 of the lower sash 14 by a series of sheet metal screws 33 as shown. Of course, the lift guide 30 may be joined with the jamb rails 24, 25 by other equivalent mechanical means. The lift arms 12, 13 are, permanently connected to the inner surfaces 31*a* of the vertical guide legs 31 of the lift guides 30 by welds 35, 36 as shown in FIG. 3 and FIG. 2.

As a further specific aspect of the present invention, the outer surfaces 31*b* of the guide legs 31 function as flat guide surfaces during the translation of the window from open to closed position through cooperation with the parallel spaced inner vertical edges 37 (FIG. 3) of the outer window frame member 17. The specific spacing of the guide surface 31*b* from the inner surface 37 of the outer window frame 17 may be increased or decreased as desired or found necessary for specific installations. The cooperation of the facing two parallel surfaces 31(*b*), 37 serves as both guidance of the inner sash 14 with relation to the outer window frame 16, as well as an additional limitation of lateral movement of the sash 14 in said frame 17. Moreover, the lift rail-lift guide combination contributes to the reinforcement, stabilization, and strengthening of the inner sash, notwithstanding the nature and amount of leveraged, lift forces applied to the sash through the lift rail assembly.

The specific dimensions of the U-shaped lift rail and lift arm combination will, of course, be dependent upon the dimensions of the lower sash to be opened and closed as well as the width of the stool associated with the particular window installation. For example, with a stool width of approximately 30 inches from the window, rear edge to the front edge of the stool, the length of the lift arms 12, 13 should be at least 10 inches. The total amount of projection of the lift arms 12, 13 with relation to the stool may, of course, be customized to suit particular applications as well as to comply with individual building codes.

It will be appreciated that window types which heretofore were simply unmanageable in terms of opening and closing by elderly, infirmed, disabled, or otherwise handicapped individuals, now may be readily opened and closed through the incorporation of the new and improved lift rail construction. Moreover, by retrofitting existing windows to include the lift rail arrangement of the invention, buildings such as hospitals, nursing homes, and other institutions for the eldery and infirm may be dramatically upgraded.

It is to be understood that the specific form of the lift rail arrangement of the present invention has been provided by way of illustration only. It is meant to be representative of the principles of the present invention and changes may be made therein without departing from the clear teachings of the disclosure. For example, the lift guides, lift arms, and lift rail shown in the drawings may be fabricated as a single integral element, rather than as three separate elements. Therefore reference should be made to the following appended claims to determine the full scope of the present invention.

I claim:

1. In a window assembly having an outer frame defining an inner opening having parallel vertical edge surfaces, at least one window sash having vertical side jamb rails; a top rail extending between said jamb rails and a bottom rail extending between said jamb rails, said sash being mounted in said outer frame for sliding movement between a lower window-closed position and an upper window-open position; an improved window opening structure including:

(a) a pair of elongated, lift guide means having an L-shaped cross section, each lift guide means having a mounting leg and a guide leg connected thereto;

(b) a lift arm means projecting outwardly from each of said lift guide means;

(c) lift rail means extending horizontally between said lift arm means;

(d) fastening means securing each of said mounting legs respectively to said vertical jamb rails; and (e) joining means permanently connecting said lift arms to said guide legs;

(f) said guide legs having outer guide surfaces disposed parallel with and adjacent to the inner vertical opening surfaces of said window frame opening.

2. The window opening structure of claim 1 in which (a) said lift arm means and said lift rail means comprise an integral U-shaped element.

3. The window opening structure of claim 2, in which (a) said U-shaped element is a doubly bent steel bar.

4. The window opening structure of claim 1, in which (a) said fastening means are metal screws.

5. The window opening structure of claim 1, in which (a) said joining means are welds.

* * * * *